United States Patent [19]

Keinborg et al.

[11] Patent Number: 4,592,821

[45] Date of Patent: Jun. 3, 1986

[54] ELECTROLYSIS TANK WITH A CURRENT STRENGTH OF GREATER THAN 250,000 AMPERES FOR THE PRODUCTION OF ALUMINUM BY MEANS OF THE HALL-HEROULT PROCESS

[75] Inventors: Maurice Keinborg, Saint Ismier; Bernard Langon; Joseph Chaffy, both of Saint Jean de Maurienne, all of France

[73] Assignee: Aluminium Pechiney, Paris, France

[21] Appl. No.: 656,852

[22] Filed: Oct. 2, 1984

[30] Foreign Application Priority Data

Oct. 4, 1983 [FR] France ..... 83 16048

[51] Int. Cl.[4] ..... C25C 3/00

[52] U.S. Cl. ..... 204/244; 204/243 R; 204/243 M

[58] Field of Search ..... 204/243 R, 243 M, 244

[56] References Cited

U.S. PATENT DOCUMENTS 4,313,811 2/1982 Blanc ..... 204/243 M 4,474,611 10/1984 Blanc et al. ..... 204/244

*Primary Examiner*—R. L. Andrews

*Attorney, Agent, or Firm*—Dennison, Meserole, Pollack & Scheiner

[57] ABSTRACT

The present invention concerns an electrolysis tank for the production of aluminum by means of the Hall-Heroult process, which operates at above 250,000 amperes, in particular from 270,000 to 320,000 amperes.

The connection between each riser (7) and the anodic bus bar (5) is made by way of flexible electrical conductors (8); the central riser (7C) is disposed on the axis of the series, the two intermediate risers (7B, 7D) and the two equally spaced lateral risers (7A, 7E) through which substantially equal current strengths flow are connected to six upstream cathodic collectors (3), two central collectors (3A, 3B) two intermediate collectors (3C, 3D) and two lateral collectors (3E, 3F), and three downstream cathodic collectors (4), a central collector (4A) and two lateral collectors (4B, 4C).

Equipotential connections provide for balancing of the current between the different sections of the upstream and downstream collectors.

Those tanks are very stable in operation and have a high level of efficiency in regard to energy consumption.

8 Claims, 2 Drawing Figures

ELECTROLYSIS TANK WITH A CURRENT STRENGTH OF GREATER THAN 250,000 AMPERES FOR THE PRODUCTION OF ALUMINUM BY MEANS OF THE HALL-HEROULT PROCESS

The present invention concerns an apparatus for producing aluminium by igneous electrolysis in tanks having a very high level of current strength, being greater than 250,000 amperes, in particular from 270,000 to 320,000 amperes, and with very low levels of power consumption, substantially lower than 13,000 kWh/T of aluminium.

An igneous electrolysis tank comprises a rectangular pot whose bottom, forming the cathode, is formed by carbon blocks which are sealed on to metal bars that are parallel to the short side of the tank. The cathode is electrically connected to one or more negative conductors, referred to as 'collectors'. Fixed on to the pot is a superstructure comprising horizontal cross struts that are parallel to the long side of the tank and from which carbon anodes are suspended. The pot contains an electrolysis bath which essentially comprises alumina dissolved in cryolite. The anodes are supplied with electrical current by way of one or more positive supply conductors, referred to as 'risers'. Under the effect of the flow of current, the alumina is broken down into aluminium which is deposited on the cathode and oxygen which is combined with the carbon of the anodes. A part of the bath solidifies, in contact with the side walls of the pot, thus forming an electrically and thermally insulating bank configuration. Where the tanks are disposed crosswise, that is to say, with their long side perpendicular to the general direction of the current in the line of tanks, the ends of the bars are referred to as upstream or downstream, depending on whether they issue from the upstream or the downstream side of the tank, with respect to the direction of the current which is taken as the reference.

The tanks are connected in series, with the cathodic collectors of an upstream tank being connected to the anodic risers of the following downstream tank.

The series of tanks are formed by an even number of separate lines, one carrying the current away from the sub-station and the other returning it to the sub-station. The line that is closest to the tank being considered is referred to as the adjacent line. It plays an important part from the point of view of the tank being considered, for the magnetic field that it creates interacts with the magnetic fields of the actual tank being considered.

STATEMENT OF PROBLEM

The electrolysis tanks which are designed nowadays generally operate with current strengths of between 150,000 and 240,000 amperes. The man skilled in the art is aware than an increase in the nominal strength results both in a potential gain in regard to capital investment and in regard to production costs. That is due to the increase in daily production of the tank, which is virtually proportional to the nominal current strength and which, for a constant total production, reduces the number of electrolysis series to be installed, and the levels of power consumption of the operating equipment, and improves the productivity thereof.

The first limit in regard to increasing the size of electrolysis tanks is due to the technical difficulty in increasing the strength of the current which passes through a tank, without affecting the yields thereof.

The flow of electric current in the feed conductors and in the conducting parts of the tank generates magnetic fields which produce movements in the liquid metal and deformation of the metal-electrolysis bath interface. Those movements of the metal, which agitate the electrolytic bath under the anodes, when they are excessively substantial, may short-circuit that wave in the bath by contact between the liquid metal and the anodes.

The electrolysis yield drops substantially and the levels of power consumption rise. Those problems are amplified with the increase in amperage of the tanks as the magnetic fields are then much stronger, and the sensitivity of the bath-metal interface to the more substantial magnetic effects.

One of the most difficult disturbances to overcome is auto-instability of the layer of liquid metal. That is a self-sustained phenomenon which results in a position that is variable in respect of time of the interface between the bath and the liquid aluminium. The distance between the bottom of the anodes and the top surface of the layer of liquid aluminium is variable and the electrical resistance of the bath varies with time, beneath each anode.

The assemblies formed by each anode and the volume of bath which is associated therewith being electrically connected in parallel between the equipotential locations formed on the one hand by the cross strut and on the other hand by the liquid metal, the current strengths passing through each anode also vary in respect of time.

That induces variations in current strength in each of the conductors which carry the current from the preceding tank, the excesses or deficiencies of current which are found on the anode in question being distributed in accordance with the electrical laws of distribution of which the man skilled in the art is aware. Those induced variations in strength modify the magnetic field charts of the tank in question, on the one hand, and on the other hand, necessarily produce forced horizontal compensation currents in the metal of the preceding tank which is thrown out of balance. The presence or absence of equipotential locations, the number and the locations thereof make it possible to modify those electrical disturbances. It then becomes possible for them to be positioned in such a way that the upstream tank is electrically virtually insensitive to the disturbances of the tank in question, and the variations in magnetic fields, that are induced by the repercussion of the anodic modifications in distribution, on the distributions as between the risers, play a favourable part in damping the disturbance produced.

The flow of electric current in the feed conductors and in the electrolysis bath produces a magnetic field in the layer of liquid bath and the layer of liquid aluminium. The presence of electric current in the bath and in the metal, which is characterised at any point by a current density vector $\bar{J}$ results in the existence of electromagnetic volume forces in the bath and in the metal. Such forces which are referred to as Laplace forces are expressed in vectorial form by the following formula:

$$\vec{F}=\vec{J}\Delta\vec{B}$$

$\vec{B}$ being the vector of the magnetic field at the point of calculation.

A variation in the position of the bath-metal surface alters the values of $\vec{J}$ in the wave and in the subjacent region of liquid metal.

The Laplace forces therefore vary and may damp or amplify the interface deformation. If an amplification effect occurs, instability appears, being sustained by the rotational movements which are generalised or localised of the liquid metal. Depending on the circumstances, the period of instability phenomena may be long (30 to 60 seconds) or short (less than 5 seconds).

The period of instability is long when the movement of the metal affects all the cathodic surface or occasionally occurs in the form of two symmetrical rotational movements which affect each of the two halves of the tank that are disposed on respective sides of the transverse axis of the tank.

That occurs in particular if the vertical components of the magnetic fields remain of the same sign over each half of the tank. Such movements may be minimised by nullifying the integrated value of the vertical magnetic field over the whole of the half of the tank in question. With regard to instabilities of 'rapid' type, the metal movements are localised under certain anodes. They are generally triggered off by an irregularity in the distribution of current in the anodic assembly, as a result of operations carried out on the tanks: changing a worn anode to replace it by a fresh anode, an anode which is positioned too close to the liquid metal, running the tanks, or partial polarisation of the anodic system due to a lack of alumina in the bath.

it can be said that, in a first approximation, the lines of current in the bath are vertical. In fact, because of the very substantial differences in resistivity between the bath and the metal, if they are to arrive at points of the cathode which are not disposed in vertical alignment with their point of departure from the anode, the current lines are curved in the liquid aluminium.

In the case of an anode which carries more current than the average of the anodes, the current will then have a tendency to spread out in the liquid metal. The current lines are centrifugal in that situation. In the case of an anode which carries less current than the average of the anodes, the current lines are centripetal. In both those situations, the current density will vary in the thickness of the layer of metal.

The dynamic effect of the Laplace forces may be expressed, in the metal, by the existence of a non-zero vorticity in the region in question.

In symbolic terms, that may be written as follows:

$$\text{Rot. } \vec{F}=(\vec{B}\cdot\vec{\Delta})\vec{J}-(\vec{J}\cdot\vec{\Delta})\vec{B}$$

wherein $\Delta$ is the vector of components:

$$(\delta/\delta x,\ \delta/\delta y,\ \delta/\delta z)$$

The vertical component Rz of the rotational vector corresponds to the motor effect of rotation of the layer of metal in the horizontal plane. It can be written in expanded form as:

$$Rz=BxdJz/dx+BydJz/dy+BzdJz/dz-JxdBz/dx-JydBz/dy-JzdBz/dz$$

On the axis of the centrifugal or centripetal currents, we have:

$$dJz/dx=dJz/dy=0$$

When the values of Bz are low over the entire volume of the liquid metal, we have:

$$lowdBz/dx=dBz/dy$$

Therefore, Rz may be rounded off to:

$$BzdJz/dz-JzdBz/dz$$

which varies when Jz evolves in time as $(Bz/H-dBz/dz)\Delta Jz$. dBz/dz being generally low in relation to Bz/H when Bz is non-zero, the term $Bz/H\Delta Jz$ is representative of the sensitivity of the surface of the metal to the variations in anodic strengths, H being the height of the layer of molten aluminium and $\Delta Jz$ being the variation in Jz, that induces the movements in the metal.

The man skilled in the art then seeks to act on those three components to stabilise operation of the electrolysis tanks.

He increases the height of metal, but that results in a more substantial amount of aluminium being tied up in each tank. In addition, that gives rise to a certain amount of difficulty in the upward movement in the electrolysis tank of undissolved alumina which would be deposited on the cathode and thus increases the danger of 'caking' thereon.

He positions his current feed conductors in positions such that the vertical field at every point in the pot is weak.

He reduces the variations in current strengths in the anodes by refining the methods of operation, by automatically or manually monitoring the current strengths, anode by anode, or by regulating the position of the anodes with excessively low or excessively high current strengths, with respect to the nominal values.

In regard to tanks with a level of current strength of higher than 250,000 amperes, that results in a multiplication in the number of risers and motorisation of the anodes individually or in groups of two. That is what is done in the tanks which are the subject-matter of our French patent application No. FR A-2 505 368. Without that, the quality of the yields falls and the gains that are reckoned on, by virtue of the increase in size, are wiped out by the poor cost prices of the aluminium produced.

However, the cost of a tank is greatly increased as individual motorisation of anodes represents a very heavy capital investment in comparison with that of the superstructures with overall motorisation, being the technical construction which is usually employed at strengths of up to 200 to 250,000 amperes.

The curve in respect to capital investment, in dependence on operating strength, then shows a kink at that level, which means that there is little attraction from the economic point of view in going from 200,000 to 300,000 amperes.

The design of tanks without individual motorisation above 250,000 to 270,000 amperes involves selecting original positions for the conductors, ensuring vertical magnetic fields which are lower at all points than $1.5\cdot10^{-3}$ Teslas (15 Gauss), in spite of the additional effects provided by the other lines of tanks and the other series. They also go through maximum damping of the cyclic variations in current strengths which may occur in an anode, and it is necessary to avoid that disturbance being propagated to the remainder of the tank or to the upstream tank.

STATEMENT OF THE PRIOR ART

Electrolysis tanks which are capable of operating at high current strengths and wherein the magnetic disturbances are minimised have been described previously.

In U.S. Pat. No. 3,415,724 (ALCOA), magnetic balancing is achieved by disposing the connecting conductors outside the vertical plane that goes through the short sides of the tank and by branching off a portion of the current (less than half) in two bars which pass under the central portion of the casing.

French Pat. Nos. 2 324 761 and 2 427 760 to ALUMINIUM PECHINEY (U.S. Pat. Nos. 4,049,528 and 4,200,760 respectively corresponding thereto) describe electrolysis tanks which operate at rates of 175,000 to 180,000 amperes, with exceptional levels of performance in regard to stability and energy efficiency. The vertical components of the magnetic field are of a value of zero for each half of the tank as they are equal and opposite in sign over the upstream quarter and the downstream quarter. However, if those arrangements are suitable for current strengths of lower than 200,000 amperes, extending them without other precautionary measures to tanks which use a current strength of higher than 200,000 amperes may again give rise to the above-mentioned phenomena of instability in regard to the surface of the liquid metal, and may make it necessary to increase the anode-metal spacing, while losing in anodic density, that is to say, losing in respect of production and energy consumed, which wipes out the anticipated gains.

Patent NO FR-A-2 469 475 to PECHINEY proposes extracting the cathodic current through vertical output members which pass through the bottom of the casing, a portion at least of the connecting conductors being disposed beneath the bottom of the casing.

In patent NO FR-A-2 416 276, a part of the current is carried to the following tank in the series by conductors which are disposed outside the vertical plane that passes through the short sides of the tank. Two connecting conductors pass beneath the tank and form, with respect to the axis of the tank, an angle which is not specifically stated but which appears to be of the order of 20° (see FIG. 2 of the patent).

As regards individual motorisation of the anodes or groups of anodes, reference may be made to U.S. Pat. No. 4,210,513 (ALCOA) which provides a control shaft for each line of anodes and a plurality of remotely controlled clutch means which, as desired, are operated to provide for upward or downward movement of each anode or group of anodes.

In our French patent application No FR 2 517 704, we have described a system for precise control of the anodic plane by individual motorisation of each group of two anodes, in a tank comprising a total of 40 anodes in two independent lines each of 20 anodes. As explained above, that construction which is highly satisfactory from a technical point of view involves a relatively high level of additional capital investment but it produces a permanent and accurate balance in the current passing through each group of anodes.

STATEMENT OF THE INVENTION

The present invention concerns an apparatus for the production of aluminium by the electrolysis of alumina dissolved in fused cryolite using the Hall-Heroult process, at a current strength of higher than 250,000 amperes and in particular between 270,000 amperes and 320,000 amperes, with a level of energy consumption of less than 12,600 kWh per tonne of aluminium produced, said apparatus comprising a plurality of aligned rectilinear tanks whose short sides are referred to as 'heads', being disposed crosswise with respect to their axis of alignment and electrically connected in series, as a single line or a plurality of parallel lines.

BRIEF DESCRIPTION OF THE DRAWINGS

FIG. 2 illustrates the same two tanks as FIG. 1 but, for the sake of clarity, it only shows the values of current strengths in KA passing through each conductor, in a series of tanks which operate at a value of 280 kamperes.

DETAILED DESCRIPTION OF THE DRAWINGS

In the following description, the conductors will be referred to by a simple numerical reference (3 to 16) when reference is being made to all the conductors of the same nature, and by the same numerical reference followed by a letter when reference is being made to various branches of each conductor of the same nature.

Figure 1:
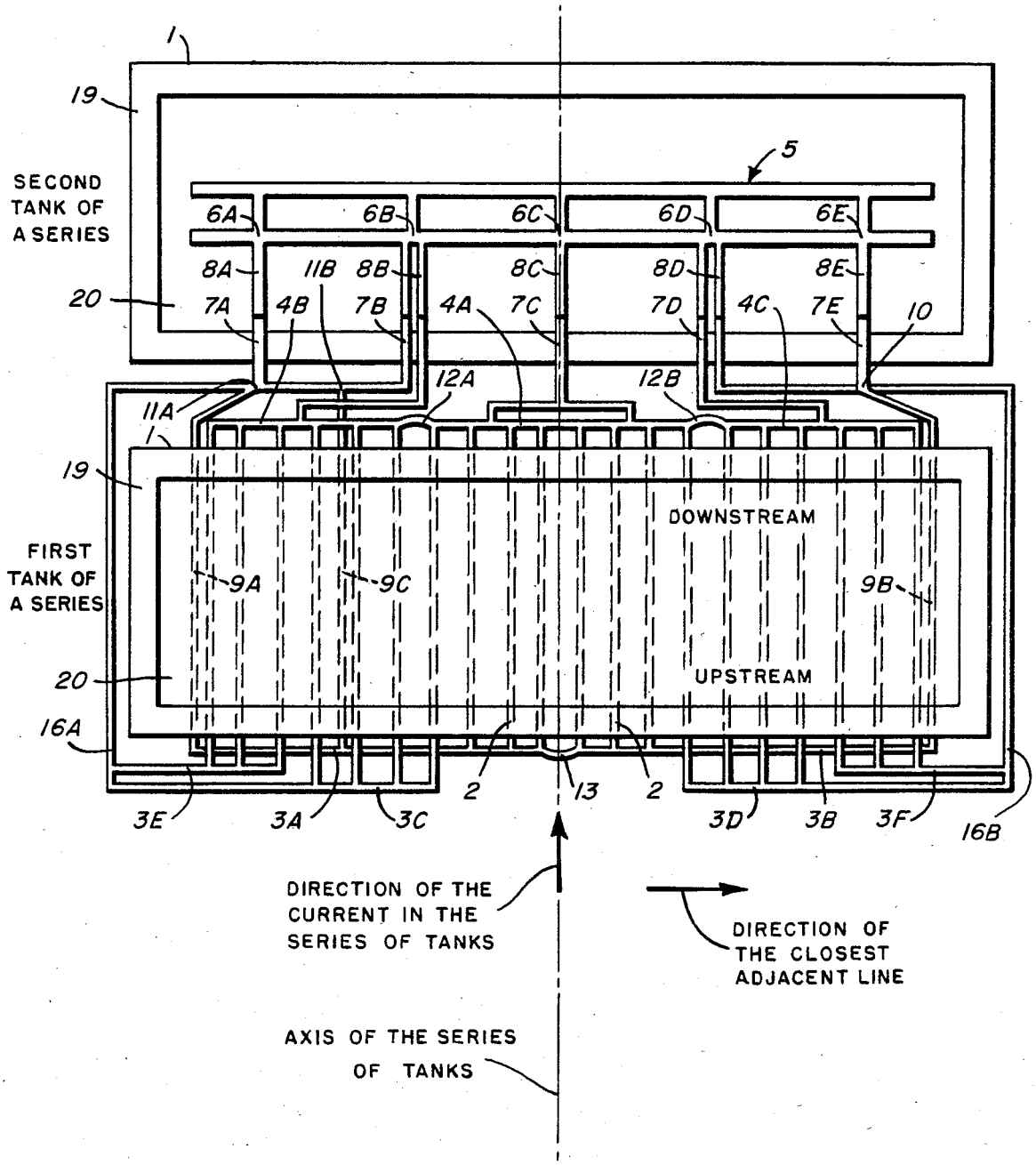
FIGS. 1 and 2, consist of schematic top plan views of two rectilinear electrolysis tanks electrically connected in series, it being understood that in an otherwise conventional installation for the production of aluminum by the electrolysis of alumina dissolved in fused cryolite, using the Hall-Heroult process, there are customarily from 100 to 200 tanks electrically connected in series.
Figure 2:
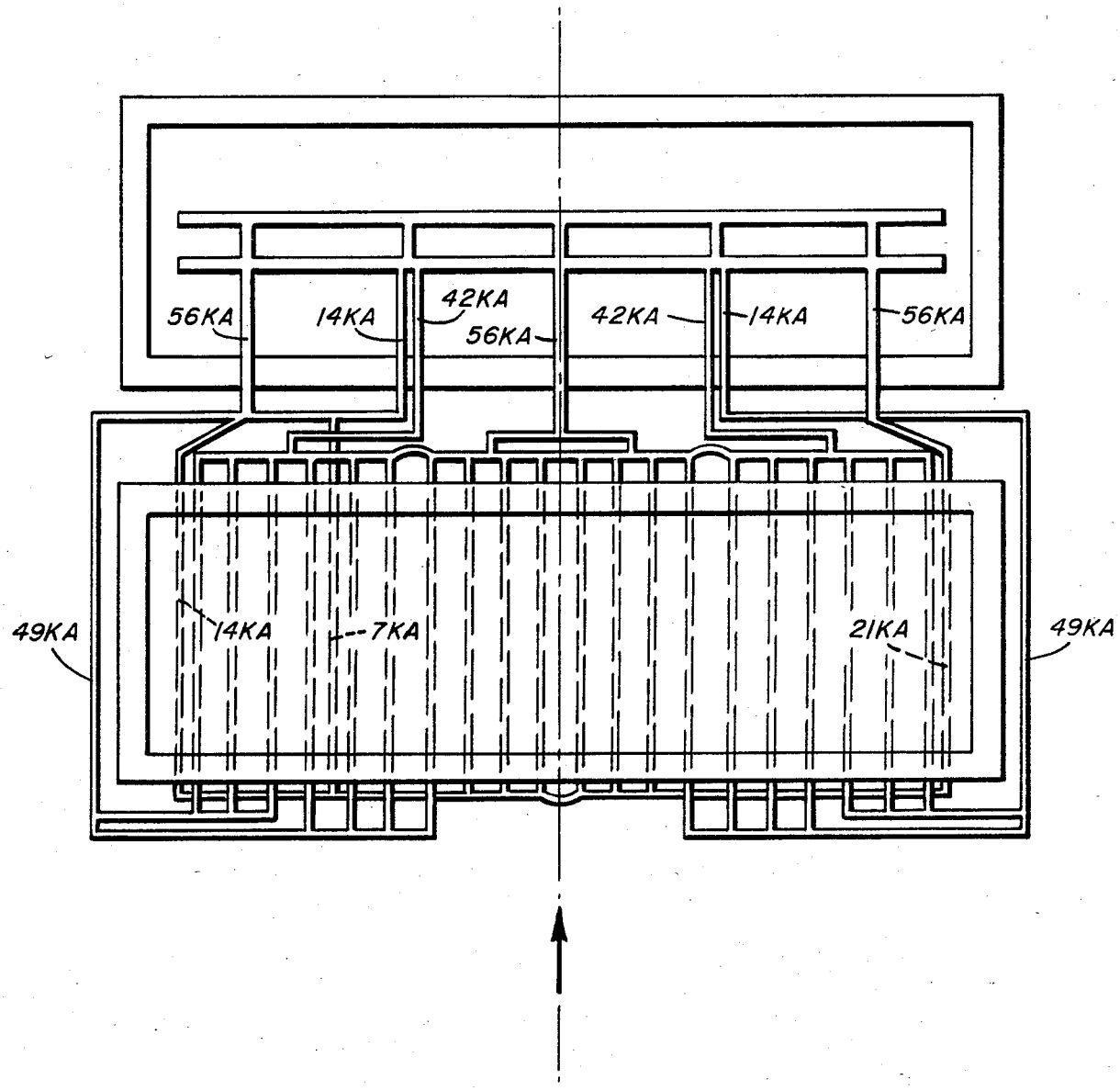

The general structure of electrolysis tanks for the production of aluminium being well known to the man skilled in the art, FIGS. 1 and 2 only set forth the elements which are essential for understanding the invention, that is to say, the electrical conductors in the true sense, as seen from above.

Each tank comprises a steel casing 1 which is lined with insulating material 19, supporting a cathode 20 formed by a plurality of juxtaposed carbonaceous blocks into which are sealed metal cathodic bars 2 which are connected to a plurality of cathodic collectors, which bars 2 for sake of simplicity of the schematic FIGS. 1 and 2 are shown in full lines in their sealed passage through cathode 20 of the first tank of a series, the illustration of which cathodic collectors is not shown in the second tank of a series of tanks, the upstream collectors of a first tank of a series of tanks being denoted by simple reference numeral 3 and all the upstream branches of the cathodic collectors being denoted by reference numerals 3A through 3F and the downstream collectors of a second tank of a series of tanks being denoted by simple reference numeral 4 and all the downstream branches of the cathodic collectors being denoted by reference numerals 4A through 4C, a plurality of prebaked carbonaceous paste anodes into which the metal anode rods are sealed, anodic bus bar 5 which is movable upwardly and downwardly and on to which the anode rods are fixed, and electrical connecting means 7 and 8 between the upstream and downstream cathodic collectors 3 and 4 of a tank, on the one hand, and the anodic bus bar 5 of the following tank in the series, on the other hand. According to the invention, the anodic bus bar 5 of each tank is connected to the preceding tank at five points 6A, 6B, 6C and 6D and 6E by five equally spaced risers 7A, 7B, 7C, 7D and 7E disposed on its upstream side 8, the connection between a riser 7 and an anodic bus bar 5 being made by a flexible electrical conductors 8A, 8B, 8C, 8D and 8E: a central riser 7C disposed on the axis of the series, two intermediate risers 7B and 7D and two lateral risers 7A and 7E, through which pass substantially equal current strengths and which are connected to six upstream cathodic collectors: two central collectors 3A and 3B, two intermediate collectors 3C and 3D and two lateral collectors 3F and 3E, and to three downstream cathodic collectors, namely a central collector 4A and two lateral collectors 4B and 4C.

The invention is further characterised by the following points:

the central riser 7C of each tank is connected to the downstream central collector 4A of the preceding tank;

each intermediate riser 7B and 7D is divided into two. One portion is connected to the lateral downstream cathodic collector of the preceding tank 4B and 4C, while the other portion is connected to the upstream cathodic collectors 3A and 3B;

each lateral riser 7A and 7E is connected to the upstream cathodic collectors 3C, 3E and 3D, 3F by lateral conductors 16A and 16B;

the electrical connection between the upstream cathodic collectors 3 and the intermediate and lateral risers 7A, 7B, 7D and 7E is made by five connecting conductors arranged as follows:

two connecting conductors 16A and 16B which pass around the heads of the tank and which each carry 35% of the upstream current, two connecting conductors 9A and 9B which pass symmetrically beneath the tank substantially in vertical alignment with the cathodic block which is closest to the head of the tank. The conductor 9B which is disposed closest to the closest adjacent line carries 15% of the upstream current while the other conductor 9A carries only 10% of the upstream current;

an intermediate connecting conductor 9C which passes beneath the tank and which is disposed substantially halfway between the axis of the series and the head of the tank, on the opposite side to the closest adjacent line. The conductor carries 5% of the upstream current;

the two connecting conductors 9B and 16B which are disposed on the side of the closest adjacent line have an equipotential location as indicated at 10 with respect to the bottom of the lateral riser of the following tank. The current is then redistributed between the lateral riser 7E and the adjacent intermediate riser 7D so as substantially to provide for equality in respect to current strengths between risers;

the three connecting conductors 16A, 9A and 9C which are disposed on the opposite side to the closest adjacent line have two equipotential locations 11A and 11B at the bottom of the lateral riser of the following tank and between that riser 7A and the adjacent intermediate riser 7B. The current is then redistributed between the two risers so as to provide for equality in respect of current strengths between risers;

the downstream cathodic collectors 4A, 4B and 4C are connected to each other by equipotential means 12A and 12B constituted by flexible electrical conductors formed by 'foil laminates', that is to say, a stack of thin aluminium plates which are welded at the two ends;

the central upstream cathodic collectors 3A and 3B are connected together by an equipotential means 13 of the same type; and each riser feeds the movable anodic bus bar at a point around which eight anodes are symmetrically disposed.

Finally, in order to prevent electrolyte from infiltrating into the sub-cathodic space, each tank may be provided, between the cathodic blocks and the refractory and insulating lining of the casing, with a layer for providing protection against impregnation of fluorine-bearing and sodium-bearing substances, comprising a material selected from at least one of the following substances; silico-aluminous substances, sandstone, Volvic lava (chemically highly resistant volcanic lava), silicon carbide, electrofused alumina, steel and silica.

These design principles have been carried into practice in an experimental series which operates at a current strength of 280,000 amperes at 3.95 to 4 volts.

Besides the remarkable degree of stability of the tank, which is revealed by the absence of any oscillatory movement of the layer of liquid aluminium, particularly low values in respect of the vertical component Bz of the magnetic field were found. The maximum values are localised at the heads of the tanks and remain below $1.5 \cdot 10^{-3}$ Teslas (15 Gauss); over 80% of the cathodic area, the field is lower than $5 \cdot 10^{-4}$ Teslas (5 Gauss).

The level of energy consumption over a period of 3 months was 12,530 kWh/T.

ADVANTAGES ATTAINED BY THE INVENTION

In comparison with the prior art and more particularly in comparison with the conductor array forming the subject-matter of our patent No FR-A-2 505 368, the advantages attained by the present invention are as follows:

1. Individual motorisation of the anodes (in groups of two) has been eliminated, hence giving a substantial reduction in cost, without thereby reviving the disadvantages due to lack of balance in respect of current between adjacent anodes.

2. The vertical component Bz of the magnetic field has been substantially reduced, being lower than $1.5 \cdot 10^{-3}$ T (15 Gauss) at all points of the tank.

3. The provision of equipotential connections 12A, 12B and 13 between the cathodic collectors also makes it possible:

(a) to provide for current balance as between the different sections of the collectors and to spread the fluctuations in current in an anode over the whole of the circuit, thereby making them virtually imperceptible;

(b) accordingly, to avoid a disturbance which occurs in a given tank having a repercussion on the upstream tank; and (c) to reduce the number of short-circuit blocks which have to be installed to shunt a damaged tank which is to be stopped for repair or replacement.

By virtue of the combination of the above-indicated advantages, it is now possible to build and operate electrolysis tanks which are substantially less trouble than those of the prior art, of equal power, in the range of from 270,000 to 320,000 amperes, with comparable technical results (service life and levels of energy consumption) and a very high degree of stability.

We claim:

1. Apparatus for the production of aluminium by the electrolysis of alumina dissolved in fused cryolite using the Hall-Heroult process, with a current strength of between 270,000 amperes and 320,000 amperes, with a level of energy consumption of less than 12,600 kWh per tonne of aluminium produced, said apparatus comprising a plurality of aligned rectangular tanks whose small sides are referred to as 'heads', being disposed crosswise with respect to their axis of alignment and being electrically connected in series as a single line or a plurality of parallel lines, each tank comprising a steel casing lined with insulating material and supporting a cathode formed by a plurality of juxtaposed carbonaceous blocks into which are sealed metal cathodic bars (2) connected to a plurality of upstream (3) and downstream (4) cathodic collectors, a plurality of prebaked carbonaceous paste anodes into which are sealed the metal anode rods, an anodic bus bar (5) which is movable upwardly and downwardly and on to which the anode rods are fixed, and electrical connecting means (16) between the upstream and downstream cathodic collectors (3 and 4 respectively) of a tank, on the one hand, and the anodic bus bar (5) of the following tank in the series, on the other hand, in which apparatus the anodic bus bar (5) of each tank is connected to the preceding tank at five points (6A, 6B, 6C, 6D and 6E) by five equally spaced risers disposed on its upstream side (8), characterised in that:

the connection between each riser (7) and the anodic bus bar (5) is made by flexible electrical conductors (8), the central riser (7C) which is disposed on the axis of the series, the two intermediate risers (7B, 7D) and the two lateral risers (7A, 7E) through which substantially equal current strengths pass are connected to six upstream cathodic collectors (3), two central connectors (3A, 3B), two intermediate collectors (3C, 3D) and two lateral collectors (3E, 3F) and three downstream cathodic collectors (4), a central collector (4A) and two lateral collectors (4B, 4C), the downstream cathodic collectors (4A, 4B and 4C) are connected together by equipotential connections formed by flexible conductors, and the central upstream cathodic collectors (3A and 3B) are also connected together by an equipotential connection formed by flexible conductors.

2. Apparatus according to claim 1 characterised in that:

the central riser (7C) of each tank is connected to the downstream central cathodic collector (4A) of the preceding tank, each intermediate riser (7B) is divided into two, one portion is connected to the lateral downstream cathodic collector (4B) of the preceding tank while the other portion is connected to the upstream cathodic collectors (3A, 3C and 3E), and each lateral riser (7A, 7E) is connected to the upstream cathodic collectors (3A, 3C, 3E and 3B, 3D, 3F) by lateral conductors (16A, 16B).

3. Apparatus according to claim 1 characterised in that:

the electrical connection between the upstream cathodic collectors and the intermediate and lateral risers is made by five connecting conductors disposed as follows:

two connecting conductors (16A, 16B) which pass around the heads of the tank and which each carry 35% of the upstream current, two connecting conductors (9A, 9B) passing symmetrically beneath the tank substantially in vertical alignment with the cathodic block which is closest to the head of the tank, the conductor (9B) disposed closest to the closest adjacent line carries 15% of the upstream current while the other conductor (9A) carries only 10% of the upstream current, an intermediate connecting conductor (9C) passing under the tank and disposed substantially halfway between the axis of the series and the head of the tank, on the side opposite to the closest adjacent line, this conductor carries 5% of the upstream current, the two connecting conductors (9B, 16B) disposed on the side of the closest adjacent line have a equipotential connection (10) at the bottom of the lateral riser of the following tank, the current is then redistributed between the lateral riser (7E) and the adjacent intermediate riser (7D) so as substantially to provide for equality of the current strengths between risers, and the three connecting conductors (16A, 9A and 9C) disposed on the side opposite to the closest adjacent line have two equipotential connections (11A, 11B) disposed at the bottom of the lateral riser of the following tank and between said riser (7A) and the adjacent intermediate riser (7B), the current is then redistributed between the two risers so as to provide for equality of current strengths between risers.

4. Apparatus according to claim 3 characterised in that each riser (8A, 8B, 8C, 8D and 8E) feeds the movable anodic bus bar (5) at a point (6A, 6B, 6C, 6D and 6F respectively) around which eight anodes are disposed symmetrically with respect to the vertical plane passing through the riser.

5. Apparatus according to claim 2 characterised in that:

the electrical connection between the upstream cathodic collectors and the intermediate and lateral risers is made by five connecting conductors disposed as follows:

two connecting conductors (16A, 16B) which pass around the heads of the tank and which each carry 35% of the upstream current, two connecting conductors (9A, 9B) passing symmetrically beneath the tank substantially in vertical alignment with the cathodic block which is closest to the head of the tank, the conductor (9B) disposed closest to the closest adjacent line carries 15% of the upstream current while the other conductor (9A) carries only 10% of the upstream current, an intermediate connecting conductor (9C) passing under the tank and disposed substantially halfway between the axis of the series and the head of the tank, on the side opposite to the closest adjacent line, this conductor carries 5% of the upstream current, the two connecting conductors (9B, 16B) disposed on the side of the closest adjacent line have an equipotential connection (10) at the bottom of the lateral riser of the following tank, the current is then redistributed between the lateral riser (7E) and the adjacent intermediate riser (7D) so as substantially to provide for equality of the current strengths between risers, and the three connecting conductors (16A, 9A and 9C) disposed on the side opposite to the closest adjacent line have two equipotential connections (11A, 11B) disposed at the bottom of the lateral riser of the following tank and between said riser (7A) and the adjacent intermediate riser (7B), the current is then redistributed between the two risers so as to provide for equality of current strengths between risers.

6. Apparatus according to claim 1 characterized in that each riser (8A, 8B, 8C, 8D and 8E) feeds the movable anodic bus bar (5) at a point (6A, 6B, 6C, 6D, and 6F respectively) around which eight anodes are disposed symmetrically with respect to the vertical plane passing through the riser.

7. Apparatus according to claim 2 charazterized in that each riser (8A, 8B, 8C, 8D and 8E) feeds the movable anodic bus bar (5) at a point (6A, 6B, 6C, 6D, and 6F respectively) around which eight anodes are disposed symmetrically with respect to the vertical plane passing through the riser.

8. Apparatus according to claim 5 characterized in that each riser (8A, 8B, 8C, 8D and 8E) feeds the movable anodic bus bar (5) at a point (6A, 6B, 6C, 6D, and 6F respectively) around which eight anodes are disposed symmetrically with respect to the vertical plane passing through the riser.

* * * * *